US011089881B2

(12) United States Patent
Louks et al.

(10) Patent No.: US 11,089,881 B2
(45) Date of Patent: Aug. 17, 2021

(54) MODULAR MATTRESS AND BEDFRAME SYSTEM WITH SURFACE POSITIONING ACTUATORS

(71) Applicant: NANTHEALTH, INC., Culver City, CA (US)

(72) Inventors: Ronald A. Louks, Greenville, NC (US); Sandip Reddy, Los Angeles, CA (US)

(73) Assignee: Nanthealth, Inc., Culver City, CA (US)

( * ) Notice: Subject to any disclaimer, the term of this patent is extended or adjusted under 35 U.S.C. 154(b) by 214 days.

(21) Appl. No.: 16/221,360

(22) Filed: Dec. 14, 2018

(65) Prior Publication Data

US 2019/0183255 A1 Jun. 20, 2019

Related U.S. Application Data

(60) Provisional application No. 62/599,634, filed on Dec. 15, 2017.

(51) Int. Cl.

| | |
|---|---|
| ***A47C 31/12*** | (2006.01) |
| ***A47C 27/08*** | (2006.01) |
| ***A61G 7/057*** | (2006.01) |
| ***A47C 31/00*** | (2006.01) |

(Continued)

(52) U.S. Cl.

CPC ..... *A47C 31/123* (2013.01); *A47C 27/083* (2013.01); *A61G 7/05707* (2013.01); *A61G 7/05715* (2013.01); *A47C 27/10* (2013.01); *A47C 27/128* (2013.01); *A47C 31/003* (2013.01); *A47C 31/008* (2013.01)

(58) Field of Classification Search

CPC ..... A61G 7/05707; A61G 7/05715; A47C 27/083; A47C 27/128; A47C 27/10; A47C 31/12; A47C 31/123; A47C 31/003; A47C 31/008

See application file for complete search history.

(56) References Cited

U.S. PATENT DOCUMENTS 4,542,547 A * 9/1985 Sato ..... A47C 27/082 5/713
4,799,276 A * 1/1989 Kadish ..... A61G 7/0573 137/901

(Continued)

FOREIGN PATENT DOCUMENTS

EP 0568957 11/1993

*Primary Examiner* — David R Hare

(74) *Attorney, Agent, or Firm* — Stetina Brunda Garred and Brucker

(57) ABSTRACT

The inventive subject matter provides a modular mattress system wherein the mattress surface may be adjusted for positioning of a user's body. The mattress system deploys a number of interconnected mattress cells. The mattress cells may have varying characteristics, and combinations of mattress cells may be interconnected to form a complete mattress. The proximal surface is formed of padding material and collectively form the entire mattress surface when connected. At least one actuator is mechanically coupled to padding material and an actuator controller in communication therewith directs movement of the actuator to position the padding material. A mattress cell communication interface is communicably coupled to the actuator controller and configured to communicably couple with at least one external device.

21 Claims, 3 Drawing Sheets

(51) Int. Cl.
*A47C 27/12* (2006.01)
*A47C 27/10* (2006.01)

(56) References Cited

U.S. PATENT DOCUMENTS 4,852,195 A * 8/1989 Schulman ..... A61G 7/05776 5/713
5,090,077 A * 2/1992 Caden ..... A61G 7/05715 5/713
5,446,933 A * 9/1995 Gabelhouse ..... A47C 23/002 5/670
5,502,853 A 4/1996 Singleton et al.
6,383,153 B2 * 5/2002 Dabir ..... A61H 7/001 601/134
6,487,738 B1 * 12/2002 Graebe ..... A47C 23/043 267/82
6,721,981 B1 * 4/2004 Greenhalgh ..... A47C 23/002 5/253
6,829,797 B2 12/2004 Partian
7,069,610 B1 * 7/2006 Chai ..... A61G 7/057 177/144
7,520,011 B1 * 4/2009 Liberkowski ..... A47C 23/002 5/731
8,528,135 B2 9/2013 Turo et al.
8,572,783 B2 * 11/2013 Moutafis ..... A61G 7/05769 5/655.3
8,863,338 B2 * 10/2014 Dzioba ..... A61G 7/05769 5/655.3
9,314,109 B2 * 4/2016 Saunders ..... A47C 23/125
9,591,995 B2 * 3/2017 Blumberg ..... A47C 17/04
9,724,257 B1 * 8/2017 Chen ..... A61G 7/05769
10,010,187 B1 * 7/2018 Mencio ..... A47C 7/35
10,238,561 B2 * 3/2019 Sheth ..... A61G 7/05776
10,245,197 B2 * 4/2019 Sheth ..... A61H 9/0021
2004/0231057 A1 * 11/2004 Sabin ..... A47C 31/08 5/716
2006/0085919 A1 * 4/2006 Kramer ..... A47C 27/083 5/713
2008/0034501 A1 * 2/2008 Hyde ..... A61F 5/05 5/613
2009/0237264 A1 9/2009 Bobey et al.
2013/0019408 A1 * 1/2013 Jacofsky ..... G16H 40/63 5/613
2013/0152308 A1 6/2013 Valdemoros Tobia et al.
2015/0351982 A1 * 12/2015 Krenik ..... A61G 7/018 5/616
2017/0128297 A1 * 5/2017 Cernasov ..... A61B 5/1036
2018/0337325 A1 11/2018 Han et al.

* cited by examiner

MODULAR MATTRESS AND BEDFRAME SYSTEM WITH SURFACE POSITIONING ACTUATORS

CROSS-REFERENCE TO RELATED APPLICATIONS

This application claims benefit of priority to U.S. Provisional Application No. 62/599,634, filed Dec. 15, 2017, the contents of which are expressly incorporated herein by reference.

STATEMENT RE: FEDERALLY SPONSORED RESEARCH/DEVELOPMENT

Not Applicable.

BACKGROUND

1. Technical Field

The present inventive subject matter relates to a mattress system used to support the body of a patient, the mattress system having modular interconnectable sections. The mattress sections are in electrical communication with a control system that may deploy actuators in the mattress sections to cause desired pressure against or positioning of the patient body.

2. Background

The background description includes information that may be useful in understanding the present inventive subject matter. It is not an admission that any of the information provided herein is prior art or relevant to the presently claimed inventive subject matter, or that any publication specifically or implicitly referenced is prior art.

Hospital and long-term care beds for convalescing patients typically include a static mattress that overlays a bedframe. During the course of treatment of a patient, adjustments of the body of the patient within the bed is desirable and many times necessary for treatment, medical procedures, feeding, comfort, to aid avoiding muscle atrophy and avoiding decubitus ulcers (pressure sores). Typical hospital and treatment beds includes articulating bedframes that cause a portion of the bed to incline or recline so that a patient can raise the head or feet depending on the desired positioning. In such typical hospital bed arrangements, the mattress remains static and conforms to the movement of the bedframe. Despite the many body types, weights and sizes, the hospital bed positioning systems are relatively the same for each patient and there is typically very little, if any, further adjustment specific to the patient.

It is known to medical practitioners and caregivers that prolonged confinement to bed due to medical conditions can have a negative impact on a patient's health. Ailments associated with being bedridden for long periods of time include pressure ulcers (bed sores), muscle atrophy, pulmonary congestion, back pain and sleep problems, among others. As such, it may be medically necessary or desirable for comfort to periodically move a patient in a bed to help address these issues. Typically, hospital beds only allow for the raising of the head or feet, or a combination of both, but in many instances, manual turning of the body is required in addition to the movement of the typical hospital bed. Manual turning requires significant effort on the part of one or more health practitioners as the patient may not be able to assist in movement. Depending on the physical strength of the caregiver, manual movement of the patient may not be possible. Manual turning comes with the risk of injury to both the caregiver and patient. Also, manual turning requires regular assistance of caregivers or healthcare practitioners, increasing costs and burden on healthcare facilities or patient families.

In many healthcare or long-term care instances, the patient is unable to communicate discomfort or other reasons for necessary movement in the convalescing bed. In such instances, it is incumbent upon the healthcare practitioner to anticipate required movement, and frequent manual movement may be required with the efforts of the practitioner or caregiver. As such, it may be unknown to the practitioner or caregiver that the patient is suffering from a malady caused by the positioning in the bed without some further empirical information to assist.

Thus, there remains a need for a system and apparatus for an improved patient support mattress that is configurable for the needs of particular patients to suit size, weight or medical condition. Also, there is a need in the industry for a healthcare bed system that can provide adjustment beyond the typical head or foot incline and decline associated with standard hospital beds and that also provides movement of the mattress surface for effective and therapeutic body positioning. Further, there is a need in the industry for a healthcare bed system that can provide movement of the patient in the bed without the assistance of a healthcare provider and caregiver, and which can also include safe autonomous movement of the patient based upon a user command, a timer or sensor feedback without the presence of a healthcare practitioner.

Aspects of inventive subject matter may employ the use of image detection through the use of cameras or other sensors. There exist various methods of image-based object recognition. See, for example, U.S. Patent Application Pub. Nos. 2015/0049939 entitled "Metric-Based Recognition, Systems and Methods," 2015/0161474 entitled "Feature Density Object Classification, Systems and Methods" (issued as U.S. Pat. No. 9,466,009), 2015/0254510 entitled "Object Recognition Trait Analysis Systems and Methods," 2015/0261803 entitled "Edge-Based Recognition, Systems and Methods," 2015/0262036 entitled "Global Visual Vocabulary, Systems and Methods," 2015/0278224 entitled "Image Recognition Verification," 2015/0294188 entitled "Invariant-Based Dimensional Reduction of Object Recognition Features, Systems and Methods" (issued as U.S. Pat. No. 9,460,366), 2015/0310306 entitled "Robust Feature Identification for Image-Based Object Recognition" (issued as U.S. Pat. No. 9,558,426), 2015/0324998 (issued as U.S. Pat. No. 9,412,176), 2015/0363644 entitled "Activity Recognition Systems and Methods" (issued as U.S. Pat. No. 9,547,678), 2016/0012597 entitled "Feature Trackability Ranking, Systems and Methods," 2016/0259815 entitled "Large Scale Image Recognition Using Global Signatures and Local Feature Information," 2016/0259816 entitled "Global Signatures for Large-Scale Image Recognition," and 2016/0275353 entitled "Fast Recognition Algorithm Processing, Systems and Methods" (issued as U.S. Pat. No. 9,508,009), the entirety of each of which is wholly incorporated herein by reference. Among such methods are those that make use of edge detection algorithms, e.g. to determine edge-based feature descriptors for a digital image.

All publications or issued patents listed herein are incorporated by reference to the same extent as if each individual publication, patent or patent application were specifically and individually indicated to be incorporated by reference.

Where a definition or use of a term in an incorporated reference is inconsistent or contrary to the definition of that term provided herein, the definition of that term provided herein applies and the definition of that term in the reference does not apply.

BRIEF SUMMARY

The inventive subject matter described herein provides a modular mattress system and associated bed-services for use in hospitals, medical care facilities, nursing homes and other uses where it desirable for a human patient or human user to have the mattress surface adjusted for positioning of the body. Unlike typical mattresses used in hospital beds that conform to the bedframe and movement of the bedframe, the disclosed mattress system is adapted to contour the mattress surface to provide variable positioning of the body.

The mattress system of the inventive subject matter described herein deploys a number of interconnected or communicatively coupled mattress cells. The mattress cells can have varying characteristics, and as such, combinations of mattress cells can be interconnected to form the entire mattress in different configurations that may be supported by a bedframe.

The plurality of individual and interconnectable mattress cells collectively form a mattress when aggregated. Each mattress cell may be comprised of a proximal surface layer for contacting and supporting the human body. The collective aggregate of proximal surfaces of the cells form the mattress surface that supports and contacts the body when in use. The proximal surface of each cell may be comprised of padding material. The padding material can be formed of polyurethane foam, latex foam, visco-elastic foam, memory foam, high density foam, rubber or other conventional mattress materials.

Below or beneath the proximal surface layer of certain of the mattress cells, one or more actuators are mechanically coupled to the padding material. The actuators are adapted to move proximal (upward or toward the patient) and distal (downward or away from the patient) to provide a desired contour of the proximal surface layer. For example, to raise a portion of the patient's body or to increase pressure on the body a particular point, the actuator would be initiated to push upwardly against the patient. As a further example, to lower a portion of the patient's body or to relieve pressure on the body a particular point, the actuator would be initiated to pull downwardly away from the patient.

Each mattress cell can comprise one actuator or a plurality of actuators. An actuator of the cell may be referred to herein as a pixel actuator. The actuators can be viewed as pixels in an array. For example, a mattress cell can include a two-dimensional array of actuators arranged in plurality of rows and columns. As such, the pixel point (an actuator) in the array can be initiated to move according to a pixel address. In addition, when a plurality of cells are interconnected they form a larger array of actuators or pixel actuators. It is contemplated that the cells can include as many actuators as is physically possible. Alternatively, a cell may include only a single actuator. In some instances, a cell may not include any actuators and act as an area on the aggregate mattress where no actuation is required or desired. For example, the edges of the mattress may not include pixel actuators.

A pixel actuator controller is communicatively coupled with the pixel actuators and is configured and adapted to control a physical position of the padding material via the pixel actuators. The controller may comprise a processor such a microprocessor and a non-transitory memory having stored software instructions. The controller may be on-board the mattress cell, where it is solely dedicated to the actuators on board the mattress cell. Also, the controller may direct or control off-board actuators of sister mattress cells connected directly or indirectly to the cell on which the controller is physically located. In this regard, each of the mattress cells may have their own dedicated controller or received instructions for the actuators from controllers outside of the mattress cell. For example, a controller could be located on a sister interconnected mattress cell, located adjacent the aggregate mattress attached to the bedframe or integrated with a bed controller interface or located remotely by a cloud-based controller which is interconnect by, for example, Wi-Fi or a long range cellular transceiver or via a wired or wireless LAN.

The mattress cell additionally comprises a mattress cell communication interface communicatively coupled with the pixel actuator controller and configured to communicatively couple with at least one external device. In this regard, each onboard device of the mattress cell may be communicatively coupled to an outside device which allows the pixel actuator controller to be on-board the mattress cell or external to the mattress cell. Additionally, the communication interface permits the exchange of data to external devices such as external servers or data collection devices or system. For example, a sensor or plurality of sensors may reside on-board a cell and such sensor may be interconnected to the communication interface to transmit sensor data to a controller.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of certain embodiments of modular mattress system wherein mattress components are interconnectable to assemble a mattress and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

The following description includes information that may be useful in understanding the present disclosure. It is not an admission that any of the information provided herein is prior art or relevant to the presently claimed inventive subject matter, or that any publication specifically or implicitly referenced is prior art.

The inventive subject matter provides apparatus, systems, and methods that enable a modular mattress system wherein mattress components are interconnectable to assemble a mattress. Each of the modular components are in electrical communication with a controller or processor and each incorporate an array of actuators that may be initiated by the controller as a function of commands, sensor feedback or other input. The actuators of the various mattress cells position the surface of the mattress to conform, move, or adjust a body placed on the mattress. Electrical communication as referenced herein may include wired or wireless interconnection.

The system of the inventive subject matter provides a modular mattress system and bed-services ecosystem for use in hospitals, medical care facilities, nursing homes and other uses where it desirable for a human patient or human user to have the mattress surface adjusted for positioning of the body. Unlike typical mattresses used in hospital beds that conform to the bedframe and movement of the bedframe, the disclosed mattress system is adapted to contour the mattress surface to provide variable positioning of the body.

Figure 1:
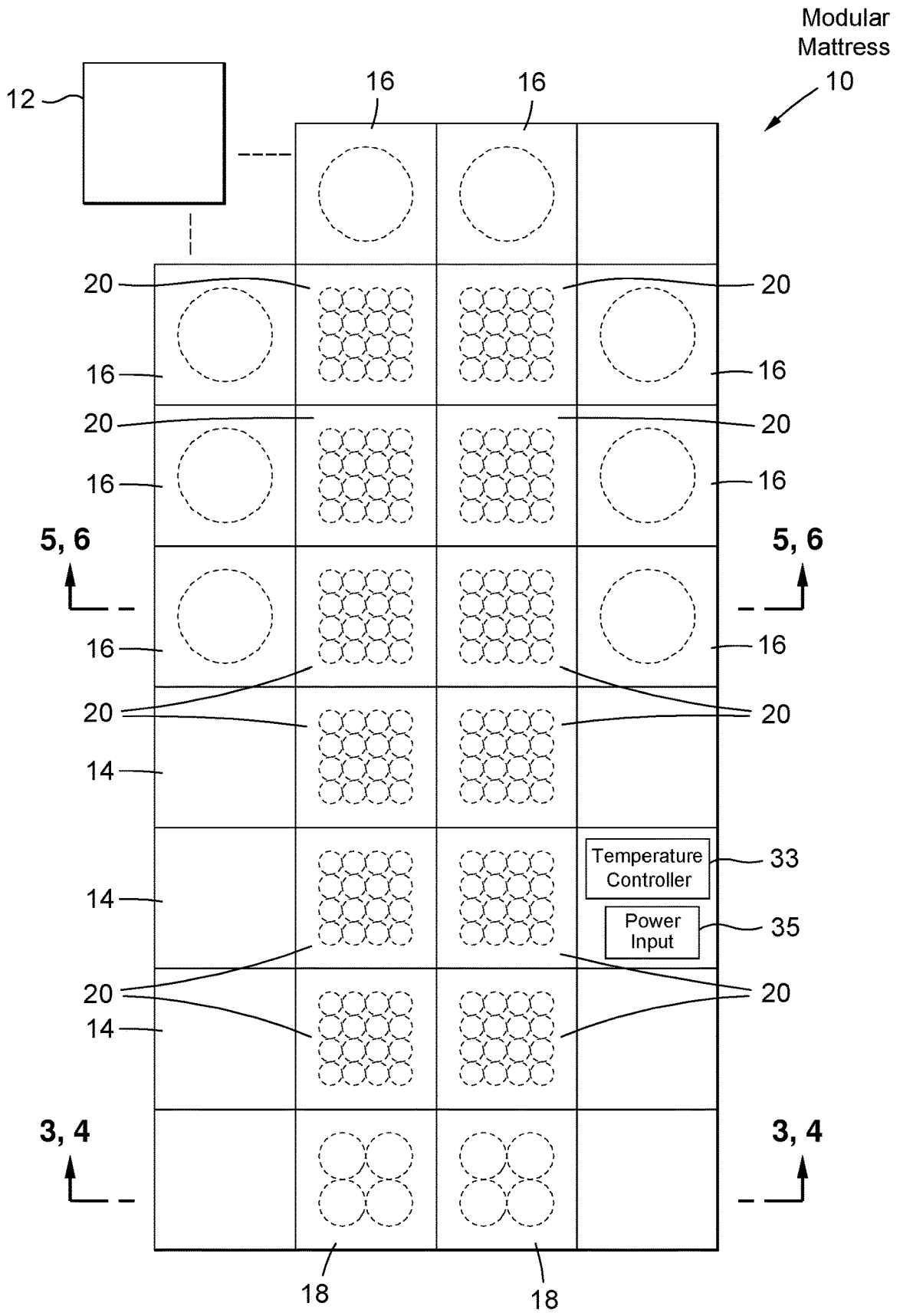
FIG. 1 is a schematic diagram of the disclosed modular mattress system of the showing an arrangement of modular cells that make up a mattress system and related arrays of actuators.

Referring particularly to FIG. 1, there is shown and exemplary assembly of a mattress 10 constructed in accordance with the modular mattress system as disclosed. FIG. 1 shows a top plan view of a mattress 10 that incorporates an array of cells 12, preferably coupled with a complementary bedframe, wherein the top padded layer is not shown to demonstrate the configuration of the actuators for each cell. It will be understood that the configuration of FIG. 1 is exemplary in nature and the arrangement of mattress cells can have a large number of configurations.

Each mattress cell can comprise zero, one actuator or a plurality of actuators. An actuator of the cell may be referred to herein as a pixel actuator. The actuators can be viewed as a pixels in an array. For example, a mattress cell can include a two dimensional array of actuators arranged in plurality of rows and columns, although other configurations are contemplated. As such, the pixel point (an actuator) in the array can be initiated to move according to a pixel address (e.g., a GUID, an IP address, an identifier, etc.). In addition, when a plurality of cells are interconnected they form a larger array of actuators or pixel actuators. It is contemplated that the cells can include as many actuators as is physically possible. Alternatively, a cell may include only a single actuator. In some instances a cell may not include any actuators and act as an area on the aggregate mattress where no actuation is required or desired. For example the edges of the mattress may not include pixel actuators as such areas are less likely to have contact with a portion of the bed user or patient. It should be further appreciated that the cells could have other arrangements of actuators beyond a 2-dimensional array of rows and columns. Other arrangements can include a circular arrangement, a hexagonal (e.g., honeycomb, etc.) arrangement, triangular arrangement, or other non-rectangular arrangements.

The mattress system of the inventive subject matter deploys a number of interconnected mattress cells 12. The mattress cells 12 can have varying characteristics, and as such, combinations of mattress cells can be interconnected to form the entire mattress in different configurations that may be supported by a bedframe (not shown). Any number (0 to N) of actuators could be included on a particular cell. In the exemplary construction of FIG. 1, the mattress 10 includes four different types of cells, including stationary cells 14 (NULL) that have no actuators. While stationary cells do not include actuators to provide movement, such cells may include sensors and communication interfaces to connect with external devices, including adjacent cells and may also allow pass-through communications to other devices; a bedframe controller, a local bed-services server, or even a remote bed-services cloud-based system. The mattress 10 of FIG. 1 also includes single actuator cells 16. In a single actuator cell, a single actuator is deployed such as solenoid and piston arrangement that can apply broader force over an area to adjust the contour of upper surface of the cell. In FIG. 1, the cells 16 are positioned on the mattress bed at the upper body head area and arms. In some embodiments, mattress cells to be used in the head area may include specific feature such as transcranial magnetic stimulation, vibration or other similar features.

FIG. 1 also shows use of a further 2×2 cell 18. In this case the 2×2 cells are provided in the foot area of the mattress bed. The cell 18 would include four (4) actuators that could provide more movement "resolution" since there are four points of contact as comparted to one point of contact with cells 16. Further, FIG. 1 shows the use of twelve (12) 4×4 cells 20 that run along the mid-section of the mattress 10. The 4×4 cells 20 deploy sixteen (16) actuators, again providing more control over smaller movements of the mattress surface. Higher resolution cells such as cells 20 can provide more refined movement of the mattress contours due to the greater number of actuators in areas were the bed user or patient will likely have a higher degree of contact.

The configuration of a particular mattress of a plurality of different cells could be determined by sensor feedback. For example, a plurality of cells or a plurality of actuators may include sensors to form an array of sensors. In a case where the cells and/or actuators have piezoelectric sensor or other force sensor to measure weight, weight distribution could be measured to determine the outline of the patient. The outline could be determined by edge detection calculations from the sensors. Sensor configurations and methods of monitoring force of an object on a surface are disclosed for example in U.S. Patent Application Pub. Nos. 2018/0337325 published on Nov. 22, 2018 entitled "Multi-element Piezo Sensor for In-Bed Physiological Measurements", the entirety and substance of which is expressly incorporated herein by reference. In addition, other sensors, such as a camera overlooking the mattress could determine the outline of the person using image edge detection. The sensor feedback could be used to either suggest a particular type of mattress cell to be used in an area of the mattress (such has a higher or lower number of actuator pixels) or to provide feedback to a user or actuator controller to provide movement of particular actuators in the mattress to achieve a particular result. For example, the actuator position (e.g., up, down, left, right, etc.) could be control or the speed of movement of the actuator. In addition, the plurality of sensors could provide feedback to measure movement of the person as a function time, and the information could be supplied to a data collection database located external to the mattress through wired (such as LAN, RS232 etc.) or wireless (such as Wi-Fi, 802.11, Bluetooth®, WiGiG ect.) connections. The data collection server could be a local based bed-services server, or a remote bed-services server that is accessible over a network or a cloud-based server.

Each mattress cell, for examples 12, 14, 16, 18 and 20 may be physically interconnectable to provide a stable mattress. The cells may interconnect and/or interlock like puzzle pieces having male connectors female connectors to form the mattress 10. In more preferred embodiments, the connectors are flexible to allow the aggregated mattress to articulate as in a standard hospital bed without the cells becoming disconnected. Examples of mechanical interlocking include, but are not limited to tongue and groove configurations, friction fit, hook and loop attachments or nesting into complementary recesses formed in a bedframe below the mattress. In addition, the interlocking of the mattress cell pieces may additionally include "one way" coupling to ensure that each of the mattress cells have proper orientation, particularly with differing pixel actuator array configurations. Although each cell is shown as homogenous squares in FIG. 1, it is contemplated that cells vary in shape; a cell that is four times as long as it is wide for example; referred to as a 1 by 4 cell. It is contemplated that the cells may interlock in variety of shapes, both homogenous and non-homogenous. In addition, the cells may electronically interface through communication interfaces where the communication interfaces may provide an additional mechanism for interlocking the cells. In addition, a mattress could be provided as a prearranged pack for a particular configuration, with instructions for assembly in for a particular health condition. For example a prearranged pack of cells could be provided for an immobilized patient, that when constructed properly could assist in turning the patient. Still further, the cells could be sold individually or could themselves be modular to allow a user to insert actuators or to incorporate desired sensors.

In addition mattress cells may be releasably engaged to a mattress 10 or bedframe, and a particular cell could be removed and replaced by a new cell for at least the following reasons: patient health condition changes; one or more actuators malfunction and need to be replaced; the cell becomes soiled and replacement is desire; and removal of a cell for cleaning.

The plurality of individual and interconnectable mattress cells collectively form a mattress when aggregated. Each mattress cell may be comprised of a proximal surface layer for contacting and supporting the human body. The collective aggregate of proximal surfaces of the cells forms the mattress surface that supports and contacts the body when in use.

Figure 2:
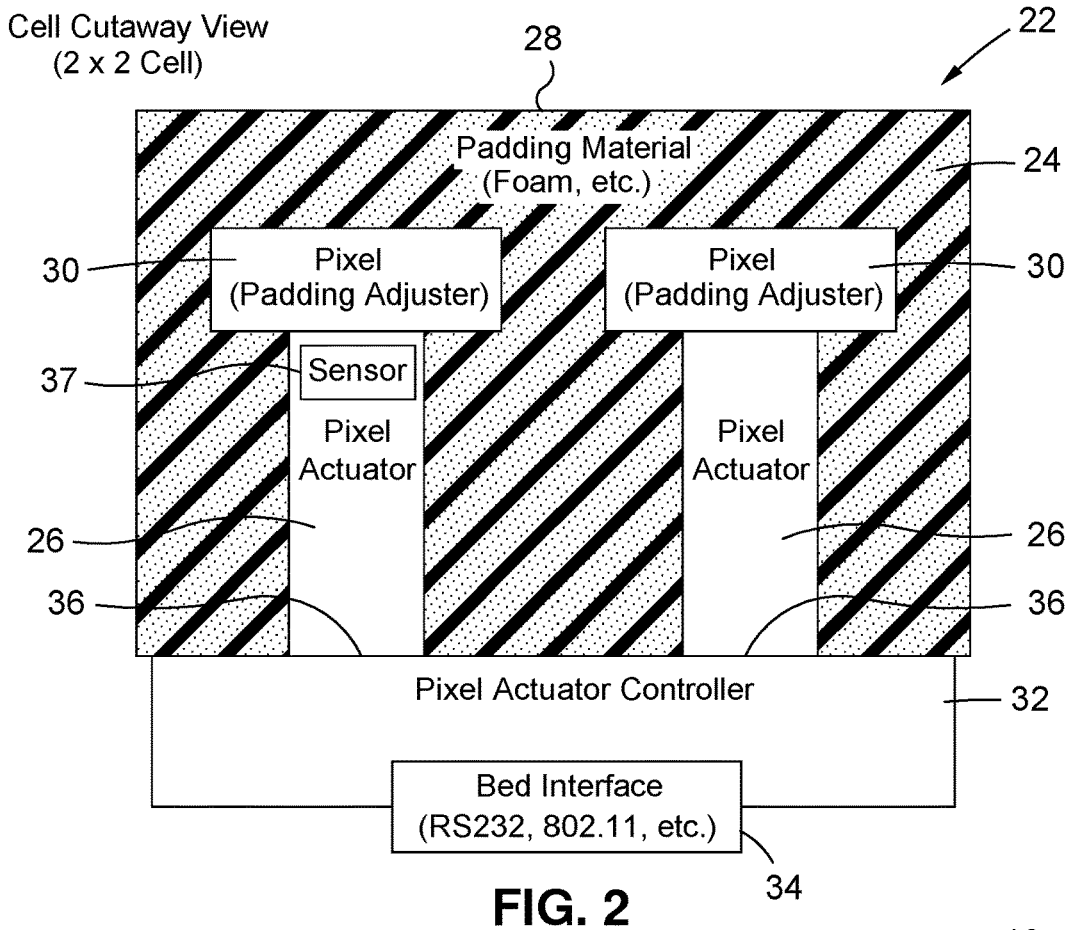
FIG. 2 is a schematic cross sectional view of a modular cell of the mattress system showing actuators and an interconnected actuator controller.

Referring particularly to FIG. 2, there is shown an exemplary mattress cell 22. In the example shown in FIG. 2, there is provided an example of a 2×2 actuator cell, having four actuators. Note that the use of "n×m" refers to the arrangement of actuators in a cell, while "n by m" references to the geometry of the cell. FIG. 2 is cell cutaway view demonstrating the interior of cell 22. Padding material 24, such as memory foam envelopes actuators 26. The padding material 26 forms the proximal surface 28 of the pad, the portion that comes in contact with the patient either directly or through bedding such as a mattress pad or sheet. The padding material 24 can be formed of polyurethane foam, latex foam, visco-elastic foam, memory foam, high density foam or other conventional mattress materials. The padding 24 of the mattress cell may be color coded for a visual indicator as to the configuration of the mattress cell such as the number actuator pixels under the foam, since the same may not be apparent from the mattress cell exterior.

Actuators 26 are mechanically coupled to the padding material 24 through padding adjusters 30 that provide, in this example, a greater surface area for engaging the padding material 24. The padding adjusters 30 may be embedded or mechanically fixed to padding 24 to provide greater movement of the proximal surface 28. The adjuster 30 may be fixed to the padding material through any number of fixation methods including at least adhesive bonding, hook and loop fastener, magnetic attraction and chemical bonding. The bases of the actuators 36 may rest upon a rigid base plate (not show) to provide stability for movement or otherwise may come in direct contact with a bedframe (not shown). The actuators 26 are adapted to move proximal (upward or toward the patient) and distal (downward or away from the patient) to provide a desired contour of the proximal surface layer 28. For example, to raise a portion of the patient's body or to increase pressure on the body a particular point, the actuator 26 would be initiated to push upwardly against the patient. As a further example, to lower a portion of the patient's body or to relieve pressure on the body a particular point, the actuator 26 would be initiated to pull downwardly away from the patient. One should note actuators in a cell are able to operate independently from each other. Thus, actuators are able to work together to achieve a desired result. For example, some actuators can move proximal, while neighboring actuators could move distal to create a slope which can aid in rotating or moving a patient.

It is contemplated that the actuator could be any number of mechanical devices that would provide movement such as a piston mechanism actuator 26 as shown or at least one of the following: an air bladder, a telescoping member, a rack and pinion, a worm screw, a solenoid, a hydraulic cylinder, a pneumatic cylinder, a fluid bladder, magnetic levitation, air compression and a biasing member. Each type of actuator could serve different purposes. A solenoid, for example, might be best used at the edge of a bed where fine-grained control over an actuator extension is less critical. While an air bladder or worm-screw might be best used where fine-grained control is required due to having greater likelihood of touching sensitive skin (e.g., burn victims, ulcers, etc.) and allows for gentle treatment. It is contemplated that actuators in addition to providing proximal and distal forces to contour surface 28, other actuator mechanisms could provide pitch, yaw, rotation, tilt, vibration, speed, velocity, acceleration, retraction and touch reaction of the proximal surface 28. As such the patient body can be positioned in a number of ways by the changed contour of the proximal surface 28. It is contemplated that the movement of the actuators 26 could facilitate the movement or rolling over of the entire patient through a series of coordinated actuator movements across different cells. Likewise, the actuators could provide more simple movement like the raising of the torso or legs of the patient. Touch reaction may employ the use of a sensors (not shown) embedded in the padding material that upon movement or touch of an area of the mattress, the actuator reacts to either raise or lower. The sensor may be an active sensor or a passive sensor such as an RFID sensor. The sensors may also provide feedback to the system to provide pressure a point on the mattress, temperature, the existence of moisture, movement or other medical or physical measurements. Example sensors that could be coupled with the actuators, with the surface of the cells, or other aspects of the cells can include galvanometer sensors, piezoelectric sensors, pulse-ox sensors, thermal sensors, infrared detectors (e.g., CCDs, etc.), accelerometers, ECG, EEG, audio sensors, or other types of sensors. Such sensors can directly, or indirectly, communicatively couple with the actuator controller to permit sensor data to be sent to external devices (e.g., a bedframe controller, bed-services server, a local or remote server, a cloud service, etc.).

In some aspects of the disclosed inventive subject matter, padding material 24 may be selectively removable from one or more mattress cells to facilitate cleaning or other manipulation of the padding material 24 or actuators 26. In the attached configuration the padding material 24 is fixedly secured to the mattress cell so as not to be dislodged in use. The padding 24 may be releasably secured through at least one of the following: friction fit, hook and loop configuration and adhesive.

Continuing to refer to FIG. 2, a pixel actuator controller 32 is communicatively coupled with the pixel actuators 26 and is configured and adapted to control a physical position of the padding material 24 and the contour of the proximal surface 28 via the pixel actuators 26. The controller 32 may comprise a processor such a microprocessor and a non-transitory memory having stored software instructions. The controller 32 may be on-board the mattress cell, where it is solely dedicated to the actuators 26 on board the mattress cell. Also, the controller 32 may also direct or control off-board actuators of sister mattress cells connected directly or indirectly to the cell 22 on which the controller is physically located. In this regard, each of the mattress cells may have their own dedicated on-board controller 32 as discussed further below, or received instructions for the actuators 26 from controllers outside of the mattress cell. For example, a controller could be located on a sister interconnected mattress cell or otherwise be interconnected the cell through a cell communication interface 34. The communication interface 34 can be a direct wired interface (e.g., RS232, RS485, Ethernet, USB, etc.) or a wireless interface (e.g., 802.11, 802.15, WiGIG, wireless-USB, Zigbee, etc.). Also, a controller could reside on an electronic device adjacent the aggregated mattress, such as attached to the bedframe or integrated with a bed controller user interface. Also, a controller could be located remotely by a cloud based controller which is interconnected by, for example, Wi-Fi or a long range cellular transceiver or via a wired LAN. It is contemplated that each cell includes its own processor and memory, and that the plurality of cells form a mesh network.

The mattress system disclosed contemplates that the pixel actuators controller 32 can operate to manipulate the each of the actuators based upon an addressing scheme. For example, the highest level address could be assigned by hospital, with each hospital having an ID. The next level address could be the address of each bed in the hospital, each bed having a unique ID. In some embodiments, the unique ID could include an Ethernet MAC address, an IP address, a TCP/UDP port assignment, a GUID, or other type of unique ID. The mattress level address can have an ID address for each mattress cell, and then each actuator located within the mattress cell, by row and column or other addressing scheme. In addition, the controller 32 could control the actuators within a mattress to a predetermined setting to affect the contour of the surface of the mattress 10. The predetermined setting could be based on a number of criteria, such as patient stored settings, settings based on height and weight or settings based on type of disease or other diagnosis. In this regard, the electronic medical records of each patient could be matched to a bed address, and adjustments could be made to the bed as function of the patient's medical records. Also, mattress and cell on board sensors could provide information to be included in the patient medical records. In some embodiments, a module bedframe has multiple receptacles or ports through which cell couple to the bedframe. Each receptacle can have its own address within the bedframe network where the address is known to have a specific location with the bedframe. When cells are coupled to the receptacle, the cells can inform a bedframe control of the capabilities of the cells, possibly via a discovery request message.

The mattress cell 22 additionally comprises a mattress cell communication interface 34 communicatively coupled with the pixel actuator controller 32 and configured to communicatively couple with at least one external device. In this regard, each onboard device of the mattress cell 22 may be communicatively coupled to an outside device through interface 34 which allows the pixel actuator controller 32 to be on-board the mattress cell or external to the mattress cell. Additionally, the communication interface 34 permits the exchange of data to external devices such as external servers or data collection devices or system. For example a sensor may reside on-board and such sensor may be interconnected to the communication interface to transmit sensor data to a device external to the cell 22. In addition, mattress cells through on-board devices may include metadata concerning characteristics of the mattress cell including at least: cell shape; cell capabilities; on board sensors; number of actuators; or power profile.

The controller 32 as shown in FIG. 2, or as located external to the cell 22, may include a microprocessor and non-transitory memory capable of storing software instructions, and upon execution of the software instruction the processor performs at least one of the following actions: physically adjust the padding material of the corresponding mattress cell; transmit mattress cell information via the mattress cell interface to an external digital device; receive mattress data via the mattress cell interface from an external digital device; acquire mattress cell sensor data from digital sensors located proximal to the corresponding mattress cell; trigger an alert based on a mattress cell state; trigger an alert based upon detection of motion by one or motion sensors; trigger an alert based upon a duration of lack of sensor input; trigger an alert based upon temperature sensor; trigger an alert based upon a moisture sensor; toggle power to one or more of the cells; adjust temperature of the mattress cell; transmit pixel address map via the mattress cell interface to an external device; transmit metadata information via the mattress cell interface to an external device; and receive web service data via the mattress cell interface from an external digital device. In this regard, at least one of the cells 12 may include a temperature controller 33 (see FIG. 1).

The disclosed modular mattress system may be used in conjunction with a complimentary bedframe (not shown). Firstly, the bedframe may have a plurality of complimentary recesses for receiving the mattress cells to provide a stable base for the constructed modular mattress. In addition, the bedframe may have complimentary electrical connections for both power and data. As such the bedframe delivers power to a power port on each mattress cell (e.g. power input 35 as shown in FIG. 1). In addition, a data port may be provided by wired input and power wherein the bedframe acts to interconnect each of the mattress cell units. In this regard, the frame may act as a system bus or hub between the various mattress cells. Likewise, the bed with the multiple interconnected components could operate as network router as a gatekeeper between external devices and the modular mattress cells. The bedframe could also include a user interface to allow manual commands of the mattress cells and include a memory of storing data, and also could act as system server. The bedframe could include a user or graphical interface that can display or call upon any pixel actuator within a particular configured mattress comprised of mattress cells. The interface would identify the address of each cell or pixel actuator in the form of, for example, Cx,y: Px,y where the mattress cell is the block and the pixel actuator is a particular point on that block defining a location on the assembled mattress.

Figure 3:
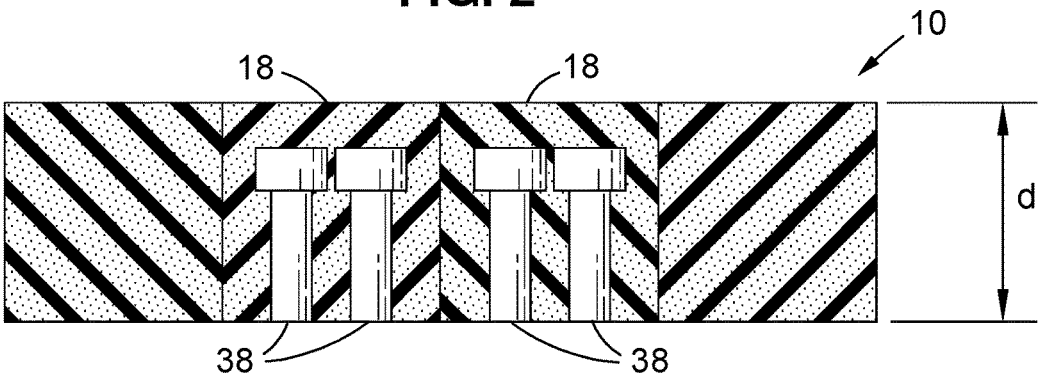
FIG. 3 is a cross sectional view of the mattress system of FIG. 1 along 3-3 axis, wherein the actuators are in a first position.
Figure 4:
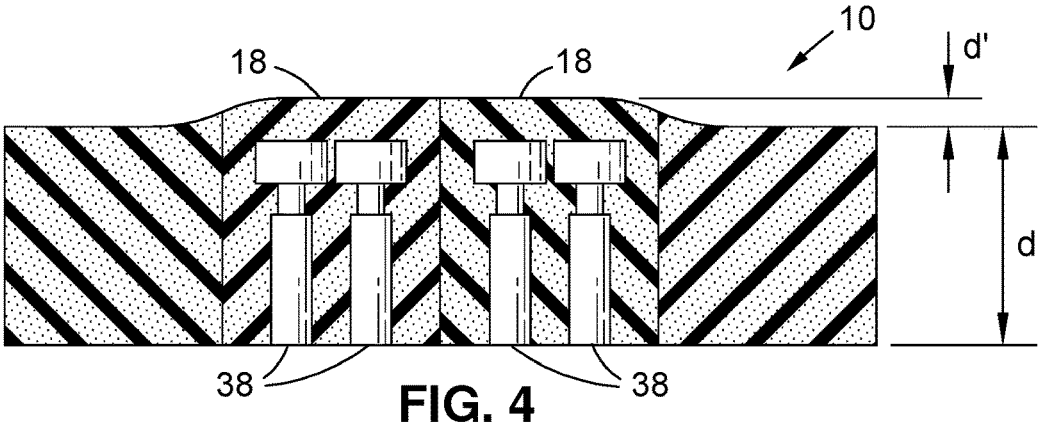
FIG. 4 is a cross sectional view of FIG. 3, wherein the actuators are in a second position creating a contoured surface.

Referring to FIG. 3 and FIG. 4 collectively, there is shown a cross section of axis 3-3 and 4-4 of FIG. 1. The actuators 38 of cells 18, are configured in a 2×2 arrangement. In the example of FIG. 3 the height of the cell 18 is the distance d. In FIG. 3, the actuators 38 are shown in a first position with the proximal surface in a neutral position, in this example flat. FIG. 4 shows the actuators 38 in a second extended position which contours proximal surface of the cell 18 to extend beyond distance d, to raise at least a portion of the proximal surface the distance of d'. the actuators 38 of cells 18 in this example are shown moving in concert, however, it its contemplated that one or more of the actuators 30 may move in the 2×2 arrangement of cell 18.

Figure 5:
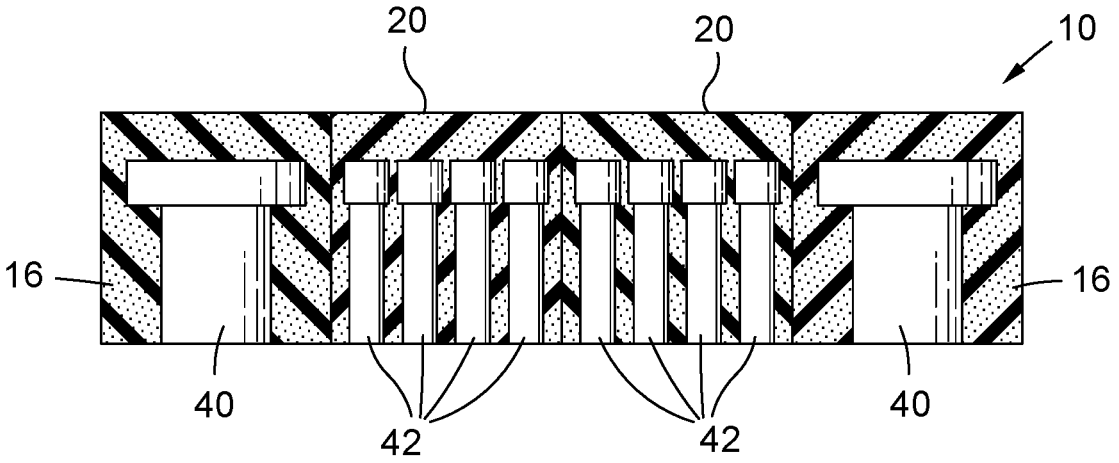
FIG. 5. is a cross sectional view of the mattress system of FIG. 1 along 5-5 axis, wherein the actuators are in a first position.
Figure 6:
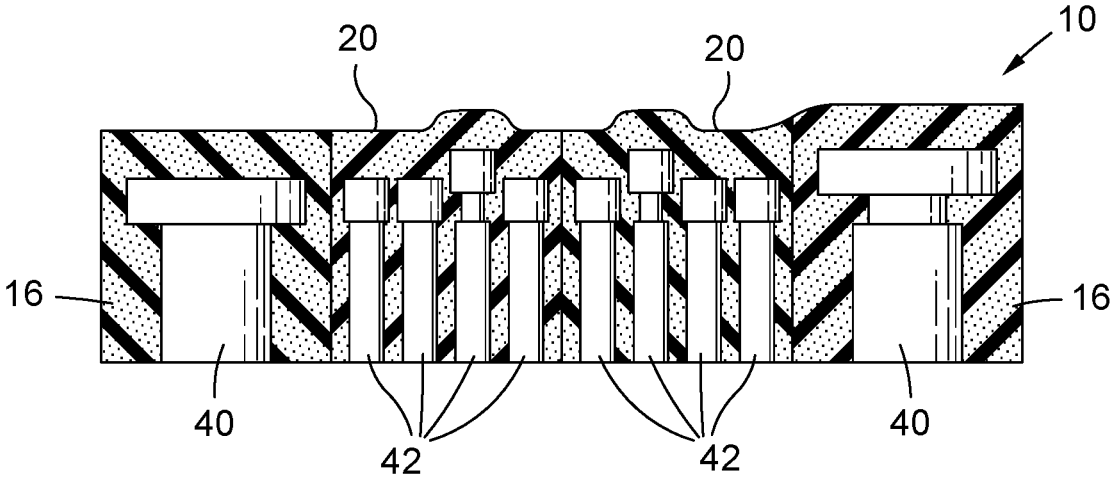
FIG. 6 is a cross sectional view of FIG. 5, wherein the actuators are in a second position creating a contoured surface.

Referring to FIG. 5 and FIG. 6 collectively, there is shown a cross section of axis 5-5 and 6-6 of FIG. 1. Cells 16 show a single actuator 40. Cells 20 include a 4×4 arrangement of actuators 42. In the example of FIG. 5, the cells 16 and 20 show each of the actuators in first neutral position. In FIG. 6, the example is intended to demonstrate that actuators may move to a second position to effect the contour of the proximal surface of the mattress 10, independent of the actuators within the same cell, or adjacent cells, such as in cells 20 of FIG. 6 wherein only one of the actuators 42 are moved to a second position. Also in the example of FIG. 6, only one of the actuators 40 is moved to an extended position in the right cell 16, independent of the neutral position of actuator 40 of the left cell 16, It should be appreciated that the disclosed inventive subject matter can exist within a larger ecosystem of coordinate care. More specifically, the disclosed modular bed system is able to integrate within a healthcare management system from a global scale down to a scale that is patient-specific. In some embodiments, the overarching modular bed system can include one or more cloud-based services that offer bed, cell, or even actuator capabilities. Such services can function as a RESTful API, often in a secured fashion, allowing stakeholders to access various forms of functionality provided by the bed-services system.

Typical functionalities can include bed management services, for example. The cloud-service can provide firmware support (e.g., update bedframe controllers, update actuator controllers, etc.), inventorying beds, monitoring beds and/or their components, collecting sensor data, securing sensor data to comply with privacy requirements such as those required by HIPAA, generating alerts based information provide beds, generating reports, logging bed-related or patient-related events, rebooting beds, or other types of management services.

Yet another type of bed-service can include providing access to various healthcare bed-based therapies via a therapy database. Various forms of therapies or bed-based patient manipulations can be stored or indexed based on types of patient diagnosis. For example, the therapy database can include bed-instructions designed to reduce bedsores or other ulcers for comatose patient. Such instructions can comprise cell-specific or actuator-specific instructions that cause the cells to reduce skin contact of the patient by lower strategic actuators around the patient body. Further, bed-instructions can also include various therapeutic massages that can be applied to specific patient body parts to increase blood flow. Such therapies can be accessed, once suitable fees have been paid or permissions have been granted, via the therapy database over a network. In this sense, the disclosed techniques can be produced as a for fee services to which hospitals or care facilities can subscribe.

Although it is possible to deploy such bed-services within the cloud, it is also possible to provide such bed-services via a local server, possibly deployed within a care organization; a hospital for example. Consider an elderly care facility have many beds and many tenants. The care facility can deploy an instance of the disclosed services on a local server where the local instance includes the necessary management functionality; a control dashboard, a therapy database, a data collection module, or a therapy creation interface, among others. Such services can be provided over the local area network (e.g., LAN, WLAN, etc.) of the facility using one or more protocols (e.g., TCP/IP, UDP/IP, HTTP, FTP, SSL, etc.) as discussed previously. Each tenant could have different requirements for their bed. The bed-services server can store information about the tenants and their associated requirements. Still further, a caretaker can access the bed-services, possibly via a browser-based user interface, to monitor data collected from a tenant's bed or to create therapies for the specific tenant. One advantage of operating a local instance of a bed-services server is that the associated services can be provided behind a facilities firewall without requiring accessing external devices that could be considered as compromising security or privacy requirements.

Of specific note, the bed-service server is able to collect data directly from a modular bed that is equipped with cells having one or more sensors. Such an approach is advantageous because it allows for direct feedback from deploying a bed-based therapy or building AI training data sets having known treatments and measured outcomes form the treatment. For example, if the goal of the therapy is to reduce ulcers, the bed-based server can collect one or more data points associated with a patient's galvanic skin response to determine if the region of skin is indeed still suffering from ulcers. The collected data can be used as feedback to alter a given therapy to ensure it is being delivered properly or should be changed to better suit the patient. Further, the collected data can be integrated with or stored in a patient's electronic medical records (EMRs). In such cases, the collected bed data can be stored in a blockchain-based EMR system as described in (see U.S. patent application publication 2015/0332283 to Witchey titled "Healthcare Transaction Validation via Blockchain Proof-of-Work, Systems and Methods," filed May 13, 2015), the substance and content of which is expressly incorporated herein by reference.

The disclosed ecosystem can also include an intelligent or smart bedframe capable of communicating with cells of a modular bed as well as remote or local bed-services servers. In such embodiments, the bedframe can comprise a processor and memory on a controller board (e.g., Raspberry PI, Arduino, PC-104, Lantronix® xPico 110, etc.) that is configured or programmed to operate as a bedframe controller. The bedframe controller communicatively couples with the various cells disposed within the bedframe and can optionally also communicatively couple with the bed-services service depending on the nature of the deployment. In embodiments where the bedframe is expected to be mobile to allow patients to be moved from one location to another, the bedframe controller could include a battery supply to power the bed and cells, and a wireless (e.g., 802.11, WiGIG, etc.) interface to communicatively couple with a bed-services server over a wireless LAN. Further, the bedframe controller can interact with the cells individually or collectively as desired via the corresponding mattress cell communication interfaces. In some embodiment, the bedframe controller can generate a discovery request sent over a bed-network to the cells (e.g., a UDP multicast, UDP broadcast, etc.). In response, the cells, or their corresponding controllers or interface, can respond with their specific information or metadata. Further, the bedframe control can communicate directly with a specific cell (e.g., TCI/IP, UDP/IP, etc.) to provide specific instructions or obtain desired data. Although these examples imply use of network stack; a TCP/IP stack operating on Ethernet, it is also contemplated that the bed-network could also operate according to other types of networking standards (e.g., RS485, USB, wireless network, etc.) or even a proprietary networking protocol.

In view that the modular bed system would be deployed in a care facility, it is expected that the bedframe should be able to adjust or articulate the entire mattress to raise or lower a patient's body parts. In such cases, the bedframe network should also be flexible enough to handle contraction or compression of mattress cell communication interfaces. This requirement can be met by interconnecting the cell ports via flexible cables (e.g., ribbon cables, etc.) or via using a low cost wireless chip sets. An example low cost and low power wireless chip capable of forming a wireless mesh includes the WiGIG 60 GHz chips offered by Tensorcom® (see URL www.tensorcom.com). In embodiments with wired mattress cell communication interfaces or ports, a more preferred wired interface lacks a requirement for a specific orientation. Thus, a USB Type-C connector would be more preferred over a DB9 RS-232 connector because the USB Type-C connector lacks a preferred connection orientation. Such an approach is advantageous because the cells will be easier to install without a required orientation.

Bedframes can also take on different forms to accommodate different patient or user requirements. Larger bedframes, say a 6 cell by 12 cell bedframe might be used for larger patients or obese patients. Smaller bedframes can be leveraged for smaller patients, including infants. Naturally, in such small embodiments, a smaller cell size might be warranted to ensure sufficient actuator coverage of such small patients.

As alluded to above, the cells of the bed can be of nearly any size (in arbitrary units) 1 by 1, 2 by 2, etc. Still further, the cells can take on different geometries beyond a square shape. For example, a cell could be a 1 by 2 cell, 1 by 3 cell, 1 by 4 cell, 2 by 4 cell, or other rectangular shape. Such geometries are useful when a uniform actuator geometry is desired across a large area of the bed or across a patient. It is also contemplated that a cell could include a corner, where three or five (or more) squares from a right angle. Right angle or "corner" shaped cells are considered advantageous for placement at the corners of a bedframe. Thus, the inventive subject matter is considered to include many different shapes or geometries of the cells (e.g., squares, rectangles, corners, hexagon, etc.).

Regardless of the cell shape or geometry, the actuator controller can couple to the bedframe network via one or more physical wired or wireless Mattress cell communications interface. It should be appreciated that a bedframe will likely have an array of interfaces for the smallest, "least common denominator", cell size. When a larger cell has a cell geometry such that it covers more than one mattress cell communications interface (e.g., a 1 by 4 cell rectangle, a corner, etc.), it is more preferable that the cell has a single interface, a plug for example, capable of interfacing to a single bedframe actuator controller physical interface. In embodiments, leveraging wireless communications, such issues are of a less concern. However, in such embodiments, the bedframe can still offer a physical power interface to the cells and actuators. Bedframe mattress cell communications interface lacking a connection to cells can be configured report back to the bedframe controller that cells at that location are NULL. The bedframe actuator interface that is connected to the cell can provide relevant cell configuration information back to the bedframe controller.

Data provided by a cell to the bedframe controller or other external device via the mattress cell communications interface can cover a broad spectrum of data regarding the cell. Examples of data can include the size of the cell, geometry of the cell, dimensions of the cells, sensor data obtained by the cell or it's actuators (e.g. by a sensor 37 as shown in FIG. 2), types of actuators, capabilities of the cells or actuators, number of actual uses, life expectancy (e.g., total allowed uses, MTBF, etc.), available sensors and their capabilities or configuration, cell or actuator identifiers, buffer sizes, memory usage, firmware version, manufacturing information, or other types of data. The cell can report such information in a serialized markup language if desired (e.g., YAML, XML, JSON, etc.). Still further, the cells are able to communicate directly, or indirectly, with the other various bedframe components (e.g., bedframe controller, remote servers, other cells, etc.) leveraging one or more protocols (e.g., TCP/IP, UDP/IP, etc.). In more preferred embodiments, the various elements of the modular mattress system secure their communications to ensure patient privacy. Example secure communications standards that can be leveraged include SL, TLS, SSH, HTTPS, or even leverage cryptographic techniques including AES, 3DES, RSA, Blowfish, Twofish, or other techniques. In yet more preferred embodiments, the modular mattress components can function within a secured execution environment to further secure privacy such as those described such as those described in U.S. Pat. No. 9,819,650 to Soon-Shiong et al. titled "Homomorphic Encryption in a Healthcare Network Environment, System and Method", filed Jul. 21, 2015.

Yet another aspect of the inventive subject focuses on the pixelated nature of the mattress system. In view that each actuator can have one or more sensors and that the associated sensor data can be reported back to a controller, server, or service, it should be appreciated that the sensor data can be treated as pixelated data. Therefore, the sensor data can be aggregated to form a sensor image of a patient on the modular mattress. The data from the sensors can be mapped to an image, which can then be analyzed via computer visions techniques. Such techniques can be leveraged to trigger bed actions once specific features are recognized or criteria is met. Consider a scenario where the sensors detect moisture or galvanic response from the patient's skin, which might be an indication of an ulcer. The corresponding sensor data can be formed into an image, possibly a contour, false color image of the patient. The bedframe controller or the bed-services server can analyze the image for edges to determine where the patient's extremities are located. The controller or server then submits instructions back to the cells or actuators to reduce pressure on the ulcers. Although edge detection is used in the previous example, one should appreciate that other computer vision techniques can also be used to recognize features of the patient as represented by the sensor data. Further, as mentioned previously, external cameras or image sensors can capture images of the patient, which can also be analyzed to trigger bed action. Example computer image processing techniques that can be leveraged for triggering bed actions include, for example, U.S. Patent Application Pub. Nos. 2015/0049939 entitled "Metric-Based Recognition, Systems and Methods," 2015/0161474 entitled "Feature Density Object Classification, Systems and Methods" (issued as U.S. Pat. No. 9,466,009), 2015/0254510 entitled "Object Recognition Trait Analysis Systems and Methods," 2015/0261803 entitled "Edge-Based Recognition, Systems and Methods," 2015/0262036 entitled "Global Visual Vocabulary, Systems and Methods," 2015/0278224 entitled "Image Recognition Verification," 2015/0294188 entitled "Invariant-Based Dimensional Reduction of Object Recognition Features, Systems and Methods" (issued as U.S. Pat. No. 9,460,366), 2015/0310306 entitled "Robust Feature Identification for Image-Based Object Recognition" (issued as U.S. Pat. No. 9,558,426), 2015/0324998 (issued as U.S. Pat. No. 9,412,176), 2015/0363644 entitled "Activity Recognition Systems and Methods" (issued as U.S. Pat. No. 9,547,678), 2016/0012597 entitled "Feature Trackability Ranking, Systems and Methods," 2016/0259815 entitled "Large Scale Image Recognition Using Global Signatures and Local Feature Information," 2016/0259816 entitled "Global Signatures for Large-Scale Image Recognition," and 2016/0275353 entitled "Fast Recognition Algorithm Processing, Systems and Methods" (issued as U.S. Pat. No. 9,508,009).

It should be noted that any language directed to a computer, controller or microprocessor herein should be read to include any suitable combination of computing devices, including servers, interfaces, systems, databases, agents, peers, engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. Further, the disclosed technologies can be embodied as a computer program product that includes a non-transitory computer readable medium storing the software instructions that causes a processor to execute the disclosed steps associated with implementations of computer-based algorithms, processes, methods, or other instructions. In some embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network a circuit switched network; cell switched network; or other type of network.

As used in the description herein and throughout the claims that follow, when a system, engine, server, device, module, or other computing element is described as configured to perform or execute functions on data in a memory, the meaning of "configured to" or "programmed to" is defined as one or more processors or cores of the computing element being programmed by a set of software instructions stored in the memory of the computing element to execute the set of functions on target data or data objects stored in the memory.

In some embodiments, the numbers expressing dimensions, quantities, quantiles of ingredients, properties of materials, and so forth, used to describe and claim certain embodiments of the disclosure are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the disclosure are approximations, the numerical values set forth in the specific examples are reported as precisely as practicable. The numerical values presented in some embodiments of the disclose may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. The term "functionally coupled to" means two elements that may be indirectly coupled to one another in a manner where one element interacts with the other element, such as a computer functionally coupled to another computer using a wireless router or a satellite functionally coupled to an antenna using a line-of-sight connection.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the disclosure and does not pose a limitation on the scope of the claimed inventive subject matter. No language in the specification should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed. Various objects, features, aspects and advantages of the inventive subject matter will become more apparent from the following detailed description of preferred embodiments, along with the accompanying drawing figures in which like numerals represent like components.

The modular mattress components are in electrical communication with a controller or other electronic devices, including other modular mattress components. The connections could be\ through wired ports such as USB, HDMI, serial, or coaxial connections, but may include wireless connections, such as Bluetooth, Wi-Fi, radio frequency, RFID, Wi-Fi Direct, cellular, infrared, WiMAX, Zigbee, or WiGIG connections. Communication to or from the modular mattress components can include long-range communications or communications such as cellular communication and Wi-Fi.

A system controller comprises at least a computer-readable non-transient memory, a processor, and computer code saved on the memory with instructions that, when executed by the processor, perform functions. Any suitable computer-readable non-transient memory that allows software instructions to be saved or allows firmware to be flashed could be used, for example a hard disk, a solid state drive, ROM, a programmable EEPROM chip.

A system controller may be local to the mattress system, or interconnected to by a remote server or device, having the capability to execute computing functions such as storing, playing, rendering, managing, modifying, transmitting, receiving, executing data and data files. Devices incorporating a system controller may include, but are not limited to computer servers, smartphones, PDAs, portable media players, smart medical devices, or other devices.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . And N, the text should be interpreted as requiring only one element from the group, not A plus N, or B plus N, etc.

The above description is given by way of example, and not limitation. Given the above disclosure, one skilled in the art could devise variations that are within the scope and spirit of the disclosure herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A modular mattress system comprising:

a plurality of individual and interconnectable mattress cells each comprising:

a proximal layer for supporting at least a portion of a human body, the proximal layer being individual to the cell and separate from the proximal layers of other cells of the plurality of individual and interconnectable mattress cells;

at least one actuator positioned at least partially beneath the proximal layer and coupled to the proximal layer;

an actuator controller in electrical communication with said actuator configured to adjust the position of the actuator to control a contour of the proximal layer relative to the cell; and a communication interface in electrical communication with said at least one actuator and said actuator controller, wherein the plurality of individual and interconnectable mattress cells includes at least one first actuator cell comprising exactly one actuator and at least one second actuator cell comprising a plurality of actuators, wherein, in said at least one second actuator cell, said plurality of actuators comprises a two dimensional array of actuators arranged in a plurality of rows and at least one column.

2. The system of claim 1 wherein, in said at least one second actuator cell, said two dimensional array of actuators is arranged in a plurality of rows and columns.

3. The system of claim 1 wherein said at least one actuator comprises one or more of the following: a solenoid, a piston, an air bladder, a worm screw, a coil.

4. The system of claim 1 wherein said at least one actuator further includes a sensor.

5. The system of claim 1 wherein at least one of the cells among the plurality of cells further includes a temperature controller.

6. The system of claim 1 wherein the communication interface is configured to communicate with an external device.

7. The system of claim 1 wherein at least one of the cells among the plurality of cells further comprises a power input for coupling to a power source.

8. The system of claim 1 wherein the proximal layer is formed of a foam cushion.

9. The system of claim 1 wherein the proximal layer is formed of a foam cushion having a color coded surface corresponding to the configuration of actuators associated with the cells.

10. The system of claim 1 wherein at least one of the cells among the plurality of cells further comprises a sensor in communication with the communication interface of the cell.

11. The system of claim 10 wherein the sensor comprises one or more of the following: a camera, a piezoelectric pressure sensor, a temperature sensor, an RFID sensor, a weight sensor and a motion sensor.

12. A modular mattress system comprising:

a plurality of individual and interconnectable mattress cells each comprising:

a proximal layer for supporting at least a portion of a human body, the proximal layer being individual to the cell and separate from the proximal layers of other cells of the plurality of individual and interconnectable mattress cells;

at least one actuator positioned at least partially beneath the proximal layer and coupled to the proximal layer;

an actuator controller in electrical communication with said actuator configured to adjust the position of the actuator to control a contour of the proximal layer relative to the cell; and a communication interface in electrical communication with said at least one actuator and said actuator controller, wherein the plurality of individual and interconnectable mattress cells includes at least one first actuator cell comprising exactly one actuator and at least one second actuator cell comprising a plurality of actuators, wherein, in said at least one second actuator cell, said plurality of actuators comprises a two dimensional array of actuators arranged in a plurality of columns and at least one row.

13. The system of claim 12 wherein said at least one actuator comprises one or more of the following: a solenoid, a piston, an air bladder, a worm screw, a coil.

14. The system of claim 12 wherein said at least one actuator further includes a sensor.

15. The system of claim 12 wherein at least one of the cells among the plurality of cells further includes a temperature controller.

16. The system of claim 12 wherein the communication interface is configured to communicate with an external device.

17. The system of claim 12 wherein at least one of the cells among the plurality of cells further comprises a power input for coupling to a power source.

18. The system of claim 12 wherein the proximal layer is formed of a foam cushion.

19. The system of claim 12 wherein the proximal layer is formed of a foam cushion having a color coded surface corresponding to the configuration of actuators associated with the cells.

20. The system of claim 12 wherein at least one of the cells among the plurality of cells further comprises a sensor in communication with the communication interface of the cell.

21. The system of claim 20 wherein the sensor comprises one or more of the following: a camera, a piezoelectric pressure sensor, a temperature sensor, an RFID sensor, a weight sensor and a motion sensor.

* * * * *